US010272559B2

(12) United States Patent
Friedrich et al.

(10) Patent No.: US 10,272,559 B2
(45) Date of Patent: Apr. 30, 2019

(54) SIDE HANDLE

(71) Applicant: Black & Decker Inc., New Britain, CT (US)

(72) Inventors: Andreas Friedrich, Limburg (DE); Volker Knop, Ulmen (DE)

(73) Assignee: Black & Decker Inc., New Britain, CT (US)

( * ) Notice: Subject to any disclaimer, the term of this patent is extended or adjusted under 35 U.S.C. 154(b) by 481 days.

(21) Appl. No.: 14/938,211

(22) Filed: Nov. 11, 2015

(65) Prior Publication Data

US 2016/0129579 A1 May 12, 2016

(30) Foreign Application Priority Data

Nov. 12, 2014 (GB) ..... 1420130.5
Dec. 22, 2014 (GB) ..... 1422974.4

(51) Int. Cl.
*B25F 5/02* (2006.01)
*B25D 17/04* (2006.01)
*B25F 5/00* (2006.01)

(52) U.S. Cl.
CPC ..... *B25F 5/026* (2013.01); *B25D 17/043* (2013.01); *B25F 5/006* (2013.01); *B25D 2222/57* (2013.01); *B25D 2250/391* (2013.01)

(58) Field of Classification Search
CPC .... B26F 5/00; B26F 5/02; B26F 5/025; B26F 5/026; B26F 5/027; B26F 5/028; B26F 5/006; B25D 17/04; B25D 17/043
See application file for complete search history.

(56) References Cited

U.S. PATENT DOCUMENTS 1,572,995 A * 2/1926 Gates ..... B62D 1/043 403/233
2,425,245 A 8/1947 Johnson
2,618,986 A 11/1952 Hungerford
3,713,350 A 1/1973 Brilando et al.
4,368,556 A * 1/1983 Wanner ..... B23B 45/001 16/436
4,509,261 A 4/1985 Bettcher
4,590,676 A 5/1986 Bettcher
4,611,671 A 9/1986 Hansson
4,637,140 A 1/1987 Bettcher
(Continued)

FOREIGN PATENT DOCUMENTS

DE 101 26 491 12/2002
DE 102004017761 A1 11/2005
EP 2 218 555 8/2010

OTHER PUBLICATIONS

European search report dated Mar. 14, 2016 issued in corresponding EP patent application.

*Primary Examiner* — Jason Daniel Prone
*Assistant Examiner* — Richard Crosby, Jr.
(74) *Attorney, Agent, or Firm* — Amir Rohani

(57) ABSTRACT

A side handle for a power tool includes a base, a grip with an elongated tubular inner section having a first end and a second end, an outer sleeve which surrounds at least part of the inner section. The outer sleeve is connected to the inner section at the first end via a connecting section. The connecting section is resiliently deformable to allow pivotal movement of the outer sleeve relative to the inner section. Damping masses can be attached to the inner section and/or outer sleeve.

17 Claims, 3 Drawing Sheets

(56) References Cited

U.S. PATENT DOCUMENTS 4,660,832 A * 4/1987 Shomo ..... A63B 49/08 16/431
4,738,166 A 4/1988 Yamaguchi
4,819,742 A 4/1989 Driggers
4,825,548 A 5/1989 Driggers
4,881,294 A * 11/1989 Riedl ..... B25F 5/003 16/426
5,157,807 A * 10/1992 Keller ..... B25D 17/043 16/431
5,170,532 A * 12/1992 Holmin ..... B25D 17/043 16/431
5,230,154 A 7/1993 Decker et al.
5,280,739 A 1/1994 Liou
5,725,422 A * 3/1998 Leweck ..... B24B 23/005 16/426
5,740,586 A * 4/1998 Gomas ..... B25G 1/10 16/430
5,845,364 A 12/1998 Chen
5,921,695 A * 7/1999 Warner ..... B25F 5/026 403/110
6,497,007 B2 * 12/2002 Newman ..... A46B 17/02 15/145
7,137,542 B2 * 11/2006 Oki ..... B25D 17/043 173/162.2
7,252,156 B2 * 8/2007 Sugiyama ..... B25F 5/026 173/162.1
7,407,444 B2 8/2008 Cera
7,676,890 B2 * 3/2010 Zhang ..... B25F 5/006 16/421
7,708,260 B2 * 5/2010 Eicher ..... B25F 5/026 173/162.2
8,141,209 B2 3/2012 Zhang et al.
8,756,766 B2 * 6/2014 Zhang ..... B25F 5/006 16/421
8,800,412 B2 * 8/2014 Griffin ..... B25F 5/026 403/235
8,813,868 B2 * 8/2014 Limberg ..... B25F 5/026 16/421
8,914,947 B2 * 12/2014 Weiss ..... B25D 17/043 16/426
9,061,412 B2 * 6/2015 Hahn ..... B25D 17/043
9,370,860 B2 * 6/2016 Rieger ..... B25F 5/006
9,463,566 B2 * 10/2016 Yoshikane ..... B25F 5/02
9,498,876 B2 * 11/2016 Schubert ..... B25F 5/026
2007/0143966 A1 6/2007 Fischer
2007/0295522 A1 12/2007 Bohne et al.
2008/0223593 A1 * 9/2008 Eicher ..... B25D 17/043 173/162.2
2008/0235913 A1 * 10/2008 Eicher ..... B25F 5/006 16/430
2009/0038818 A1 * 2/2009 Eicher ..... B24B 23/028 173/162.2
2009/0039576 A1 * 2/2009 Eicher ..... B25F 5/006 267/137
2009/0178243 A1 * 7/2009 Frank ..... B25F 5/006 16/421
2009/0283283 A1 * 11/2009 Oesterle ..... B25F 5/006 173/162.2
2010/0206595 A1 * 8/2010 Kamegai ..... B25F 5/026 173/162.2
2011/0005790 A1 * 1/2011 Frank ..... B25F 5/006 173/162.2
2012/0012353 A1 * 1/2012 Foerster ..... B25F 5/006 173/162.2
2012/0233816 A1 9/2012 Zhang et al.
2014/0020210 A1 * 1/2014 Brennenstuhl ..... B25F 5/026 16/426
2014/0251650 A1 * 9/2014 Kondo ..... B25F 5/026 173/171
2016/0075007 A1 * 3/2016 Kutsuna ..... B25D 17/043 30/272.1
2016/0129579 A1 * 5/2016 Friedrich ..... B25F 5/026 173/162.2

* cited by examiner

SIDE HANDLE

FIELD

The present invention relates to a side handle for a power tool.

BACKGROUND

Drills, in particular, hammer drills, comprise a main housing in which is mounted a spindle and a motor, which rotatingly drives the spindle via gears and/or a hammering mechanism, also located within the housing. The spindle transfers the rotational movement of the spindle or the impacts of the hammer mechanism to a cutting tool, such as a drill bit, via a chuck or tool holder attached to the end of the spindle, forward of the main housing.

Typically, such drills have two handles: a rear handle attached at the rear of the main housing and a side handle attached towards the front of the main housing, on one side of or below the main housing. Often, the side handle can be attached in a range of angular positions on the main housing.

One type of side handle comprises a hand grip which is attached at one end to a base, which in turn is attached to the side of the main housing of the drill. The hand grip typically extends away from the base and the housing in a direction generally perpendicular to the longitudinal axis of the spindle of the drill.

A problem with power tools, in particular drills, is that they generate a large amount of vibration during their operation. It is desirable to minimize the amount of vibration transferred. One way of achieving this is to provide a vibration dampener between the hand grip and the base to reduce the amount of vibration transferred from the base to the hand grip.

European Patent Document No. EP2082846, as published, describes such a design of side handle for a drill in paragraphs 45 to 52 with reference to FIGS. 7 to 13. The side handle comprises a hand grip 84 (using the same reference numbers as EP2082846) which is attached to a bolt 106 via two vibration dampeners 118, 120. The bolt 106 attaches to a base 80. The dampeners 118, 120 are made from resilient rubber. The structure of the side handle disclosed in EP2082846 is complex and difficult to assemble.

United Kingdom Patent Document No. GB2495758 provides an alternative design of side handle comprising a vibration dampener. However, the design utilizes a complex metal spring comprising a central hexagonal plate with six resiliently deformable integral arms to damp the vibration resulting in a complicated structure which is difficult to assemble.

The present invention seeks to provide a side handle having a more simplified structure than the side handles disclosed in EP2082846 and GB2495758.

BRIEF DESCRIPTION OF THE DRAWINGS

Two embodiments of the present invention will now be described with reference to the accompanying drawings of which.

DETAILED DESCRIPTION

Figure 1:
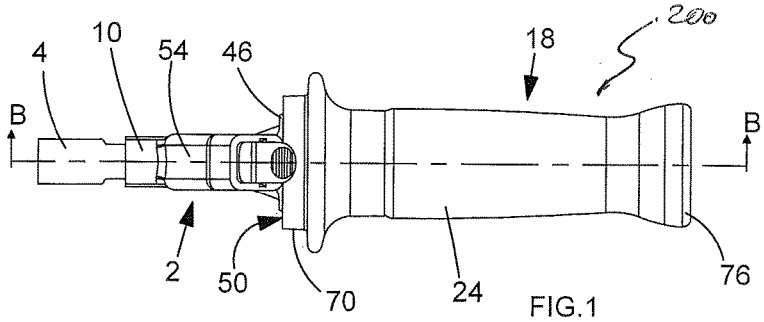
FIG. 1 shows a side view of a side handle according to the first embodiment of the present invention.
Figure 2:
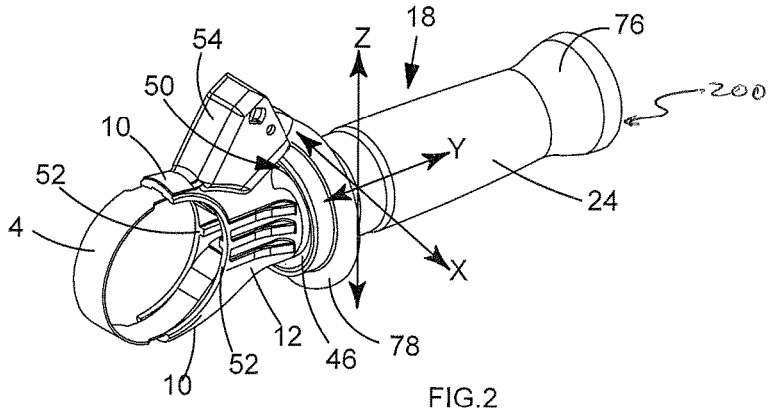
FIG. 2 shows a perspective view of the side handle of FIG. 1.

A first embodiment of a side handle 200 in accordance with the present invention will now be described with reference to FIGS. 1 to 7. The side handle 200 preferably has an attachment loop 4, a base 2 and a grip 18. The attachment loop 4 may include a flexible metal strip which is attached at both ends to the head 6 of a bolt 8.

The base 2 preferably has two engagement arms 10 attached to a tubular section 12. The engagement arms 10 may extend forward of the tubular section 12 at an angle to the tubular section 12 and may be slightly curved. The tubular section 12 is preferably rectangular in cross section and may form a tubular recess 14 with a base 16. A circular flange 46 may extend sideways from the end of the tubular section remote from the entrance to the recess 14.

Figure 3:
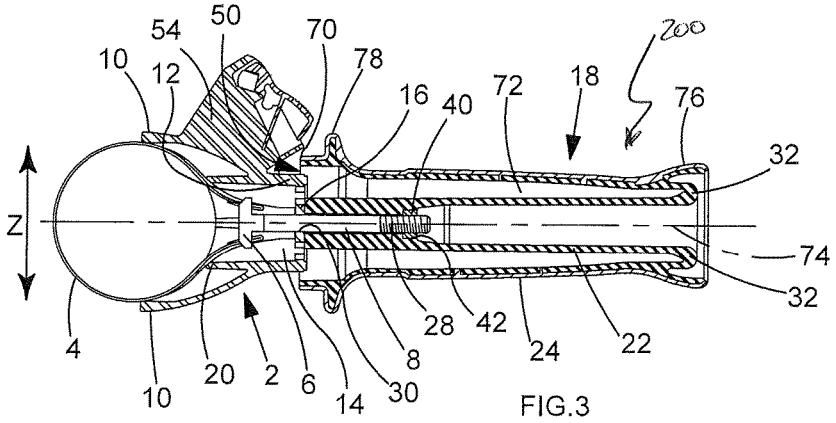
FIG. 3 shows a lengthwise cross section of the side handle in the direction of Arrows B in FIG. 1.
Figure 4:
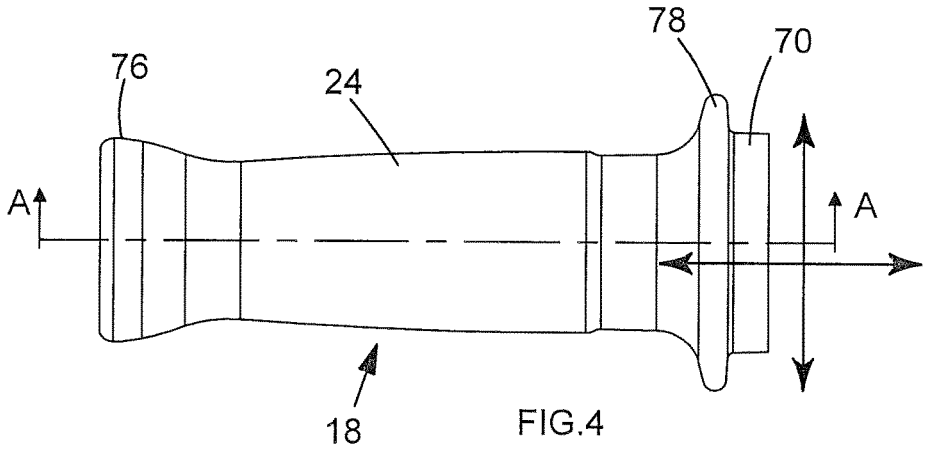
FIG. 4 shows a side view of the grip only of the side handle of FIG. 1.

The two engagement arms 10 may form curved supports 52. The head 6 of the bolt 8 and the ends of the attachment loop 4 preferably locate within the tubular recess 14. The side of the attachment loop 4 may engage with two of the sides 20 of the entrance to the tubular recess 14 and the sides of the two engagement arms 10 as best seen in FIG. 3.

The bolt 8 may be prevented from rotation within the tubular recess 14 by the attachment loop 4. The bolt 8 preferably comprises a shaft with a threaded part 28, which preferably passes through an aperture 30 formed in the base 16 of the tubular recess 14.

The grip 18 may include an inner tubular section 22 which connects via a connecting section 32 to an outer tubular sleeve 24 (which forms a hand grip for the operator) at one end 26. The inner tubular section 22 preferably has an aperture 34 formed at the other end remote from the connection section 32.

A tubular passage is preferably formed within the inner tubular section 22 in two parts. The first part 36 may be located adjacent the aperture 34 and may have a circular cross section and uniform diameter along its length. The second part 38 is preferably located adjacent the connecting section 32 and may have a circular cross section with a slightly decreasing diameter along its length from the connecting section 32 towards the first part 36. The first part 36 and second part 38 are preferably connected via a nut retaining section 42 which may be hexagonal in cross section.

The shaft of the bolt 8 may pass through the aperture 34 and along the length of the first part 36, through the nut retaining section 42, and extend into the second part 38. A nut 40, which may be threadedly engaged with the threaded part 28 of the bolt 8 and is preferably of a similar size to the nut retaining section 42, locates within and is preferably retained by the nut retaining section 42. Persons skilled in the art will recognize that nut 40 may be prevented from rotation within the nut retaining section 42 due to the hexagonal shape of the nut 40 and the nut retaining section 42.

Persons skilled in the art shall recognize that alternative designs may include having the first part 36 and second part 38 of tubular passage within the inner section 22 be connected via an insert retaining section or via an inlay retaining section instead. In such designs, the shaft of the bolt 8 would pass through either the insert section or inlay retaining section. An inlay or an insert, which each have a core thread, would be connected with the first part 36 by a form fit. In each case, the threaded part 28 of the shaft of the bolt 8 would be threadedly engaged with the inlay or the insert.

Rotation of the grip results in rotation of the nut 40 (or, in the alternative designs, in rotation of the insert or the inlay). The end of the inner tubular section 22 with the aperture 34 preferably abuts against the base 16 of the tubular section 12 of the base 2. The end 70 of the outer sleeve 24 remote from the connecting section 32 preferably extends past or nearby or congruent with and surrounds the end of the inner section 22 which may connect to the base 2 in a direction parallel to a central axis 74 as well as surrounding the circumference of the flange 46 of the base 2, leaving a gap 50 between the end of the outer sleeve 24 and the periphery of the flange 46.

A mount 54 may be attached to the side of one of the engagement arms 10. The mount 54 preferably supports a slideable depth stop (not shown) and may have a releasable latch mechanism (not shown) by which the depth stop can be axially adjusted and locked on the mount 54.

In use, the attachment loop 4 is wrapped around the body of a drill (not shown). The nut 40 (or, in the alternative designs, the insert or inlay) is then rotated by rotating the hand grip 18, causing the threaded part 28 of the shaft of the bolt 8 to screw into the nut 40 (or, in the alternative designs, the insert or inlay) as the bolt 8 is prevented from rotation within the base 2. As the threaded part 28 of the shaft of the bolt 8 screws into the nut 40 (or, in the alternative designs, the insert or. inlay), the bolt 8 is drawn towards the grip 18. This causes the bolt 8 and attachment loop 4 to be drawn into the tubular passage 14, resulting in attachment loop 4 tightening around the body of the drill. Once the attachment loop 4 is wrapped tightly around the body of the drill, the grip 18 is prevented from further rotation. At this point the curved supports 52 also abut against the side of the drill. The side handle 200 is thereby secured to the drill.

In order to release the side handle, the grip 18 is rotated in the opposite direction, thereby unscrewing the threaded part 28 of the shaft of the bolt 8 from the nut 40 (or, in the alternative designs, the insert or inlay).

Figure 5:
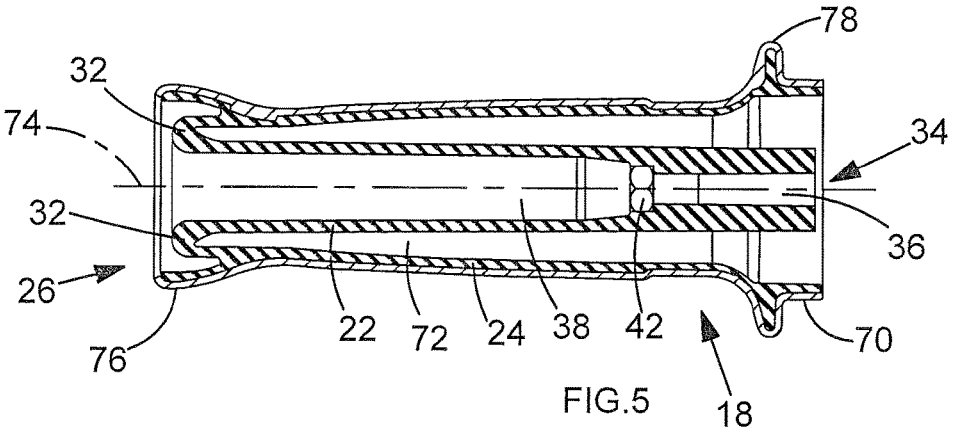
FIG. 5 shows a cross sectional view in the direction of Arrows A in FIG. 4.
Figure 6:
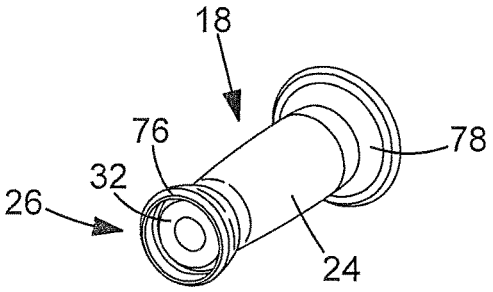
FIG. 6 shows a perspective view of the grip from a first end.
Figure 7:
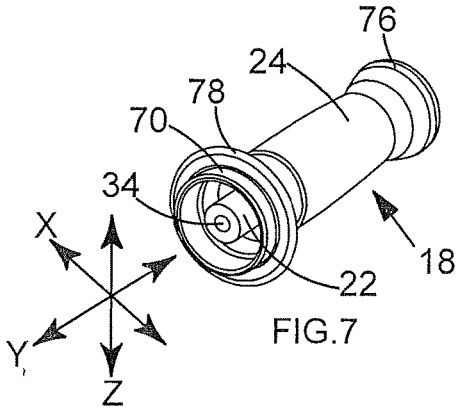
FIG. 7 shows a perspective view of the grip from a second end.

The grip 18 preferably comprises a vibration dampening system. Referring to FIGS. 3, 5 and 6, the inner section 22 and outer sleeve 24 are substantially circular in cross section along their lengths. The inner section 22 extends substantially the full length of the outer sleeve 24, the outer sleeve 24 surrounding the whole length of the inner section 22. The grip 18 may comprise a space 72 which is located between the inner section 22 and outer sleeve 24.

The connecting section 32 preferably connects to the whole circumference of the end of the tubular inner section 22. The connecting section 32 also preferably connects to the whole circumference of an inner wall of the end of the outer sleeve 24. The profile of the connecting section 32 is preferably a rotationally symmetrical sweep with regard to the central axis 74 to form a ring.

The thickness of the wall of the connecting section 32 is preferably greater than the thickness of the wall of the tubular inner section 22 and the outer sleeve 24. It will be appreciated that in alternative designs, the thickness of the wall of the connecting section 32 can be smaller than or equal to the thickness of the wall of the tubular inner section 22 and the outer sleeve 24.

The connecting section 32 may be resiliently deformable in nature and forms a vibration dampener by using structural damping effect of the material of the grip. The outer sleeve 24 can pivot about the connecting section 32 in the direction in between or equal to of the arrows X and Z (perpendicular to a central axis 74) in relation to the inner section 22 due to the resilient nature of the connecting section 32. The bolt 8 is therefore able to move in the direction equal to or in between of the arrows X and Z in relation to the outer sleeve 24.

Persons skilled in the art shall recognize that, when no pressure is applied to the grip 18 by the operator, the outer sleeve 24 is biased by the connecting section 32 to a position where the inner section 22 and outer sleeve 24 are approximately coaxial with the central axis 74 of the grip 18, with the space 72 between them extending in a uniform manner around the whole of the central axis 74 of the grip 18. The whole of the grip 18 is preferably manufactured in a one piece construction from a plastic material.

With such construction, the vibration amplitudes at the outer sleeve 24 are preferably decoupled from the vibration amplitudes at the first part 36 of the inner tubular section 22 and are respectively lower than the vibration amplitudes at the first part 36 due to the relative movement between the first part 36 of the inner tubular section 22 and the outer sleeve 24 by the connecting section 32 resiliently deforming, allowing the movement of the outer sleeve 24 relative to the inner section 22 in the direction equal to or in between of the arrows X and Z. As such, the amount of vibration transferred from the first part 36 of inner section 22 to the outer sleeve 24 is reduced.

Although the high elastic connecting section 32 is substantially responsible for the reduced vibration amplitudes at the outer tubular sleeve 24, the resiliently deformable second part 38 of the inner tubular section 22 and its ability of pivotal movement about an axis, perpendicular to central axis 74 and parallel to a direction in between arrows X and Z, placed at the passage between first part 36 and second part 38 of inner tubular section 22, also provide further vibration dampening.

Because of the high flexibility of the connecting section 32 a relative translational movement between the first part 36 of the inner tubular section 22 and the outer tubular sleeve 24 in direction of arrow Y is also possible. Thereby the transfer of vibration amplitudes in direction of arrow Y from the first part 36 of the inner tubular section 22 to the outer tubular sleeve 24 is also reduced.

The end 76 of the outer sleeve 24 adjacent the connecting section 32 preferably extends around and beyond the connecting section 32 to form an extension sleeve which surrounds the connecting section 32. This provides protection for the connecting section 32 against impacts which could damage the operation of the connecting section 32 and prevents operators hand from slipping off.

During the use of a drill with this side handle, the drill may vibrate substantially along the longitudinal axis of the drill bit, which is perpendicular to the central axis 74 of the grip 18 and by a reduced amount along a transversal axis, which is oriented in a direction that is between perpendicular and parallel to the central axis 74. The vibration amplitudes in a transversal direction to the drill bit axis are caused by an unbalanced drill bit and or an inconstant drilling torque or an inconstant drill bit rotary frequency because of the inhomogeneous nature of the material, such as concrete, into which the drill bit is drilling. The operator supports the drill using the side handle by holding the side handle by wrapping their hand around the outer sleeve 24.

As the drill vibrates, the attachment loop 4, base 2, bolt 8 and the first part 36 of the inner tubular section 22 move with the drill. However, as connecting section 32 can resiliently deform, the amount of movement transferred to the outer sleeve 24 is reduced due to the connecting section 32 bending, allowing relative movement between the outer sleeve 24 and the first part 36 of inner section 22 in a direction equal to or in between of the arrows X, Y and Z.

An operator may use the side handle to apply a forward pressure onto the drill which in turn applies a forward pressure onto the drill bit and also to provide a reaction torque to the drilling torque. In order to do this, the operator pushes the outer sleeve 24 in a direction perpendicular to the central axis 74 of the grip 18. This results in the connecting section 32 deforming slightly, increasing the size of the gap 50 between the end 70 of the outer sleeve 24 remote from the connecting section 32 and the periphery of the flange 46 on one side of the grip 18 and decreasing the size of the gap 50 between the end of the outer sleeve 24 remote from the connecting section 32 and the periphery of the flange 46 on opposite side of the grip 18. If excessive pressure is applied to the outer sleeve 24, the end 70 of the outer sleeve 24 remote from the connecting section 32 and the periphery of the flange 46 on one side of the grip 18 will make contact, the periphery of the flange preventing any further movement in the direction of Arrows Z and acting as a stop. As such, further pivotal movement of the outer sleeve 24 is prevented and the amount of deformation of the connecting section 32 is limited. The outer sleeve 24 is also prevented from making contact with the inner section 22.

A radially extending outer sleeve flange 78 is preferably formed on the outer sleeve 24 remote from the end connected to the connecting section 32 to prevent the hand from slipping off the outer sleeve 24 and engaging with the base 2. If the hand of the operator were to engage with the base 2, the benefits of vibration damping of the connecting section 32 would be reduced.

While the first embodiment describes the use of the side handle 200 with a drill, the side handle 200 is capable of being used with other types of power tools, for example, angle grinders, etc.

A second embodiment of a side handle 200 in accordance with the present invention will now be described with reference to FIGS. 8 and 9. The same reference numbers are used in the second embodiment for like parts used in the first embodiment.

The design of the side handle 200, described with reference to FIGS. 1 to 7, may be adapted to be used across different ranges of power tools, in particular drills and hammer drills, by the use of damping masses mounted at various locations on the grip of the side handle 200 and/or the use of resiliently deformable material and/or resilient deformable structures sandwiched between the inner tubular section 22 and the outer sleeve 24 in various locations. The second embodiment provides an example of a side handle 200 as described in the first embodiment with additional damping masses 79, 80 and a resiliently deformable structure 81 made of resilient deformable material mounted on the grip 18 in order to alter the vibrational damping properties of the side handle 200 and influence the natural resonant frequency of the side handle 200.

Figure 9:
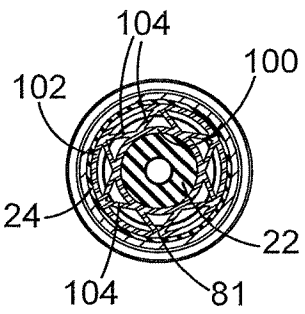
FIG. 9 shows a cross sectional view in the directions of Arrows Q in FIG. 8 through a resiliently deformable structure located inside the grip of the side handle.
Figure 8:
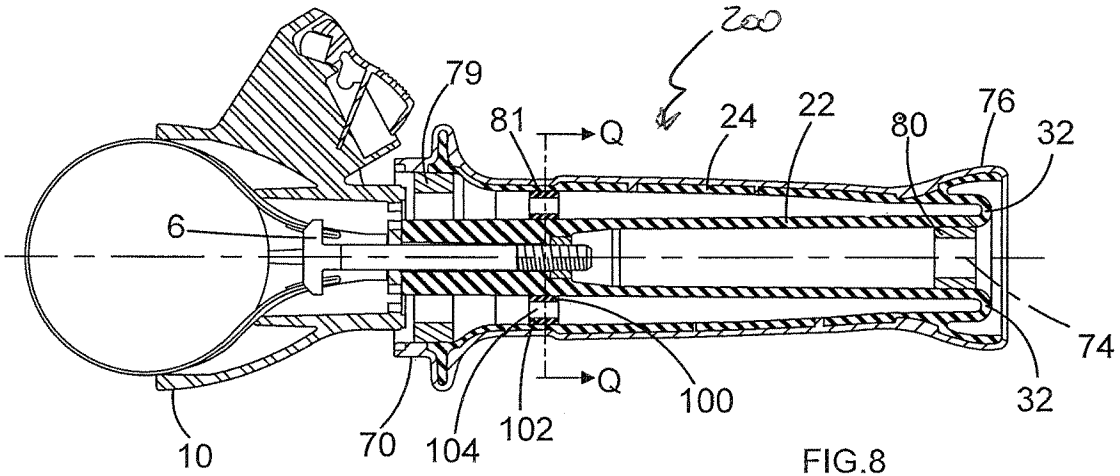
FIG. 8 shows a cross sectional view of a side handle with additional attached masses according to the second embodiment of the present invention.

Referring to FIGS. 8 and 9, a damping mass 79 is attached to the inner wall of the outer tubular sleeve 24 close to the end 70 of the outer sleeve 24. A second damping mass 80 is attached to the inner wall of the inner tubular section within the second part 38 tubular passage within the inner tubular section 22 close to the connecting section 32. The damping masses 79, 80 are both annular in shape and have profiles which are rotationally symmetrical around the central axis 74. The damping masses 79, 80 can be attached to the grip independently of each other.

A resiliently deformable structure 81 made of resilient deformable material is preferably mounted between the outer tubular sleeve 24 and the inner tubular section 22. The outer circumference of the resiliently deformable structure 81 is preferably in contact with the inner wall of the outer tubular sleeve 24 and the inner circumference of the resiliently deformable structure 81 is in contact with the outer wall of the inner tubular section 22.

The resiliently deformable structure 81 preferably comprises an inner ring 100, which is in contact with the outer wall of the inner tubular section 22, and an outer ring 102, which is in contact with the inner wall of the outer sleeve 24, interconnected by links 104. The inner ring 100, the outer ring 102 and the interconnecting links 104 are preferably made in a one piece construction from a resiliently deformable plastic material.

It will be appreciated that the resilient deformable structure could, as an alternative, be a type of spring (plastic or metal) or an elastomer or foam or rubber ring or any structure or material that is resiliently deformable and can mounted on the grip between the inner tubular section 22 and the outer sleeve 24.

The invention claimed is:

1. A side handle comprising:

a base;

a grip having a longitudinal axis, the grip being attached to the base, and comprising:

an elongated tubular inner section extending generally along the longitudinal axis and having a first end and a second end;

an outer sleeve extending generally along the longitudinal axis and surrounding at least part of the inner section; and a connecting section extending inwardly from the outer sleeve at an angle with respect to the longitudinal axis, and connecting the outer sleeve to the first end of the inner section, the connecting section being resiliently deformable to allow pivotal movement of the outer sleeve relative to the inner section about an axis perpendicular to the longitudinal axis of the grip;

wherein the outer sleeve has an end remote from the connecting section and in close proximity to the base.

2. The side handle of claim 1, wherein, when a force is applied to the outer sleeve in a direction perpendicular to the longitudinal axis, the end of the outer sleeve remote from the connecting section contacts the base.

3. The side handle of claim 1 wherein the connecting section allows relative translational movement between the inner section and the outer sleeve in a direction parallel to the longitudinal axis.

4. The side handle of claim 1 wherein a gap exists between the base and the end of the outer sleeve remote from the connecting section when no external forces are applied to the outer sleeve.

5. The side handle of claim 4 wherein the base has a radially extending flange, and the gap exists between the end of the outer sleeve and the flange on the base.

6. The side handle of claim 1 wherein the connecting section has a thickness that is equal to or is greater than a thickness of the inner section.

7. The side handle of claim 6 wherein the thickness of the connecting section is equal to or is greater than a thickness of the outer sleeve.

8. The side handle of claim 1 wherein the inner section also comprises resiliently deformable material.

9. The side handle of claim 1 wherein the connecting section is connected to an entire perimeter of the first end of the inner section.

10. The side handle of claim 1 further comprising a first damping mass is attached to the grip.

11. The side handle of claim 10 wherein the first damping mass is attached to at least one of the inner section and the outer sleeve.

12. The side handle of claim 11 wherein the first damping mass has a profile that is rotationally symmetrical as to the longitudinal axis.

13. The side handle of claim 10 further comprising a second damping mass attached to the grip, the second damping mass being separate from the first damping mass.

14. The side handle of claim 10, further comprising a resilient deformable structure mounted between the outer sleeve and the inner section.

15. The side handle of claim 14 wherein the resiliently deformable structure comprises an inner ring and an outer ring connected to the inner ring by links.

16. The side handle of claim 15 wherein the resiliently deformable structure is made in a one piece construction from resiliently deformable material.

17. The side handle of claim 14 wherein the resilient deformable structure is mounted to the grip separately from the first damping mass.

* * * * *